US005688558A

United States Patent [19]

Groshens

[11] Patent Number: 5,688,558

[45] Date of Patent: Nov. 18, 1997

[54] PROCESS OF MAKING BIODEGRADABLE TEXTILE THERMO-BONDING INTERLINING

[75] Inventor: Pierre Groshens, Peronne, France

[73] Assignee: Lainiere de Picardie S.A., France

[21] Appl. No.: 623,630

[22] Filed: Mar. 28, 1996

Related U.S. Application Data

[63] Continuation of Ser. No. 294,658, Aug. 23, 1994, abandoned.

[30] Foreign Application Priority Data

Sep. 17, 1993 [FR] France ..... 9311297

[51] Int. Cl.[6] ..... B05D 5/00

[52] U.S. Cl. ..... 427/288; 427/208.2; 427/322; 427/324; 427/366; 427/377; 427/381; 427/382; 427/385.5

[58] Field of Search ..... 427/208.2, 256, 427/288, 324, 322, 366, 381, 377, 382, 385.5

[56] References Cited

U.S. PATENT DOCUMENTS

| | | | |
|---|---|---|---|
| Re. 31,601 | 6/1984 | Ikeda et al. | 428/93 |
| 3,656,993 | 4/1972 | Edwards et al. | 117/56 |
| 4,189,931 | 2/1980 | Groshens | 66/193 |
| 5,065,599 | 11/1991 | Groshens | 66/84 A |
| 5,153,049 | 10/1992 | Groshens | 428/196 |
| 5,241,709 | 9/1993 | Kufner et al. | 2/97 |
| 5,308,663 | 5/1994 | Nakagawa et al. | 428/34.2 |
| 5,344,470 | 9/1994 | Molnar et al. | 47/58 |

FOREIGN PATENT DOCUMENTS

| | | |
|---|---|---|
| 0369046 | 5/1990 | European Pat. Off. . |
| 0481867 | 4/1992 | European Pat. Off. . |
| 0514563 | 11/1992 | European Pat. Off. . |
| 2283972 | 4/1976 | France . |
| 0196614 | 6/1938 | Switzerland . |

*Primary Examiner*—Bernard Pianalto
*Attorney, Agent, or Firm*—Ladas & Parry

[57] ABSTRACT

The textile support for thermo-bonding interlining according to the invention is constituted by a weft knit, composed exclusively of yarns of biodegradable cellulosic matter, particularly viscose, the warp being exclusively of continuous multi-filament yarns.

The support was preferably subjected, prior to the application of the thermo-fusible polymer spots, to a treatment of mechanical compacting by passage between a heated cylinder and a compression belt, the temperature of the cylinder being at the most 130° C.

The thermo-bonding interlining, comprising the textile support mentioned above, after application of the spots of thermo-fusible polymer, was advantageously subjected to a second treatment of mechanical compacting, similar to the first, the cylinder being heated only to a temperature less than 80° C.

2 Claims, 1 Drawing Sheet

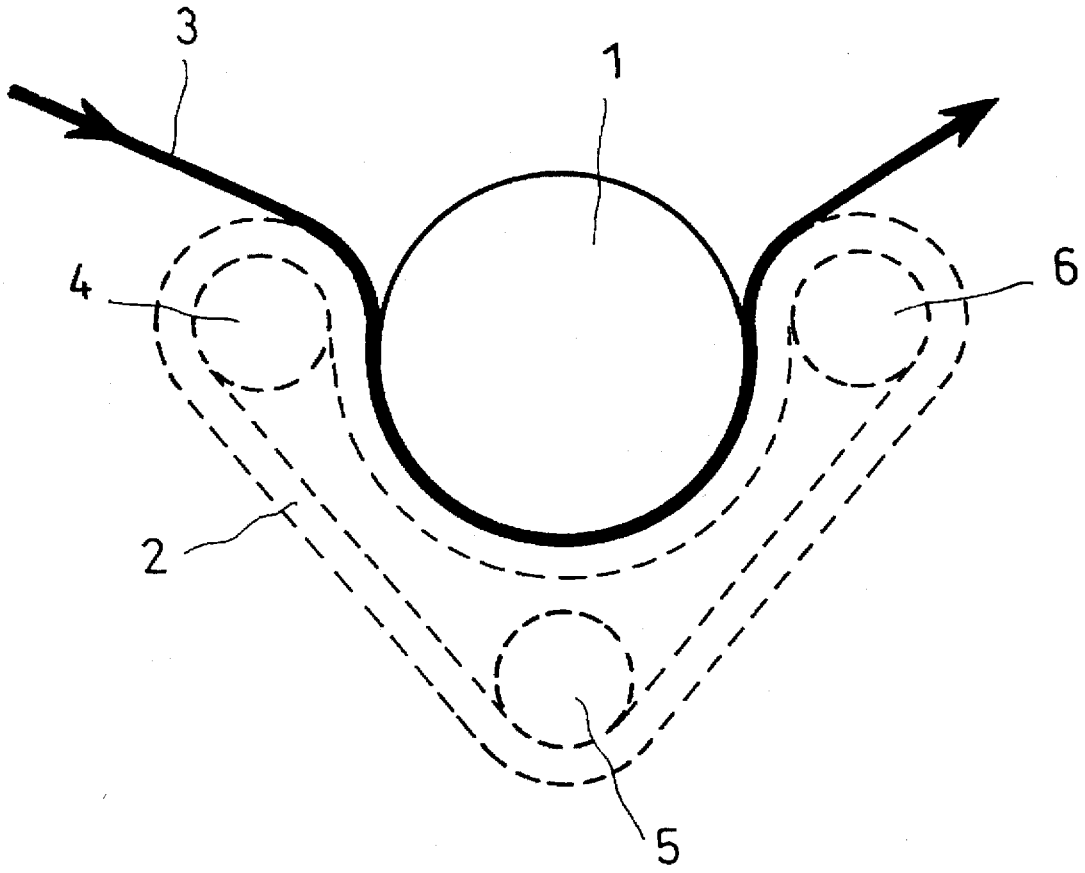
3
1
4
6
2
5

PROCESS OF MAKING BIODEGRADABLE TEXTILE THERMO-BONDING INTERLINING

This is a continuation of application Ser. No. 08/294,658 filed on Aug. 23, 1994, abandoned.

FIELD OF THE INVENTION

The present invention relates to a textile support for interlining pieces of clothing, in particular to a textile support intended to constitute a thermo-bonding interlining by deposit on one of its faces of spots of thermo-fusible polymer.

BACKGROUND OF THE INVENTION

Two categories of support for thermo-bonding interlining exist: textile supports proper and non-wovens. The textile supports proper are supports obtained by weaving or knitting yarns; the non-wovens are supports obtained by constitution and consolidation of a web of fibers or filaments. Each of these two types of support presents advantages and drawbacks. In particular, despite advantageous manufacturing costs, the non-wovens generally present differences in density and surface irregularities and an insufficient dimensional stability. On the other hand, the mode of producing textile supports proper, by weaving or knitting, gives said supports the structural homogeneity and stability lacking in non-wovens.

Due to the particular requirements associated with the protection of the environment, it is sought in all domains to propose products which are not an irreversible pollution source. It is Applicants' purpose to propose a support for thermo-bonding interlining which complies with this requirement of protection of the environment and which is of the textile support type.

SUMMARY OF THE INVENTION

This purpose is perfectly attained by the support for thermo-bonding interlining according to the invention. This support is of the textile support type in that it is constituted by a weft knit. It is characterized in that it is composed exclusively of yarns of biodegradable cellulosic matter, particularly viscose, the warp being exclusively composed of continuous multi-filament yarns.

When the support for interlining according to the invention is exclusively of viscose, it presents a certain character of biodegradability, due to the poor resistance of this matter to micro-organisms. Thus, Applicants' merit is that they have profitably used what was considered up to the present time as a drawback, while producing a type of woven stitch textile support which may be used for making a thermo-bonding interlining.

The weft knit was preferably subjected, before the application of the thermo-fusible polymer spots, to a treatment of humidification by spraying of water or by atomization of saturated steam followed by a mechanical compacting by passage between a heated cylinder and a compression belt, the temperature of the cylinder being at the most 130° C.

After compacting, the weft knit is dried and fixed on a felt calender.

This prior treatment provides the weft knit with a controlled shrinkage which gives it a sufficient stability for use thereof as textile support for thermo-bonding interlining.

Mechanical compacting provides, in addition to stability, an elasticity or extensibility in the warp direction which gives the interlining the capacity to adapt to the dimensional modifications of the cloth with which it is associated.

Such stability may advantageously be further improved by subjecting the thermo-bonding interlining of the invention, after the application of the thermo-fusible polymer spots, to a second treatment of mechanical compacting, similar to the first, the cylinder being heated only to a temperature less than 80° C.

BRIEF DESCRIPTION OF THE DRAWINGS

The invention will be more readily understood on reading the following description of an embodiment of viscose weft knit for thermo-bonding interlining and of its method of manufacture, illustrated by the accompanying drawing in which:

The single FIGURE schematically shows the treatment of mechanical compression on said weft knit.

DESCRIPTION OF PREFERRED EMBODIMENT

The present invention aims at proposing a textile support which is adapted to be used as thermo-bonding interlining and which, moreover, presents a certain biodegradability. Its purpose is to comply with the requirements in the protection of the environment.

Characteristically, it is question of a textile support in the form of a weft knit, also known as woven stitch knit, which is constituted exclusively by viscose yarns. Such a knit is made on knitting machines of the warp or Rachel type with weft insertion. More particularly, the yarn which is introduced regularly between the stitches in the width of the knit and which is called weft yarn by analogy with weaving, is a yarn either in spun yarns of fibers, or in continuous filaments. On the other hand, the yarns constituting the stitches of the knit are continuous, multi-filament viscose yarns.

Such a weft knit obviously presents the same properties as viscose, having regard to its resistance to micro-organisms: it may therefore easily be attacked by bacteria: moreover, it may be degraded by the mould which develops in an acid environment.

The structure of the weft knit, with the warp which is exclusively of continuous multi-filament yarns, is perfectly suitable for application to thermo-bonding interlining.

For a weft knit of 30 to 120 grams per $m^2$, made on a knitting machine of the warp or Rachel type with weft insertion, the weft yarn is a viscose yarn of 100 to 1000 dtex. Each of the discontinuous filaments or fibers constituting said yarn has a count of the order of 1 dtex. The yarns constituting the stitches of the knit are continuous yarns of 44 to 150 dtex, whose filaments have a count of 1 to 6 dtex.

After knitting, the weft knit is washed or dyed, then possibly subjected to a napping operation intended to improve the touch and to increase the volume of the knit. The knit is then possibly replaced on tenter frames before undergoing a treatment of mechanical compacting aiming at giving the knit a good dimensional stability.

This mechanical compacting treatment replaces the thermal treatment of shrinking and stabilization which is usual when the textile support for thermo-bonding interlining is made from synthetic yarns.

Such a treatment is already well known per se, particularly in the SANFOR® process.

Referring now to the drawing, the single FIGURE shows the essential members for carrying out this process, namely the heating cylinder 1 and the compression belt 2 made of rubber, between which the weft knit 3 to be treated is introduced.

The compression belt 2 is an endless belt which is mounted on rollers 4, 5 and 6, disposed so that said belt 2 is applied on part of the periphery of the heating cylinder 1.

The inlet roller 4 is provided with means (not shown) for adjusting the pressure of abutment of the belt 2 against the cylinder 1.

The weft knit 3 is supplied between the heating cylinder 1 and the compression belt 2 at the level of inlet roller 4. Prior to this introduction, the weft knit 3 was humidified by atomization or spraying. The shrinkage rate obtained is a function of the conditions of supply of the weft knit 3, of the respective linear speeds of the heating cylinder 1 and of the compression belt 3, and of the adjustment of the pressure means equipping the inlet roller 4. Such shrinking is fixed on the weft knit 3 as a function of the combined humidity and temperature.

It will be understood that, in order to obtain a weft knit for thermo-bonding interlining of a determined width, it is necessary to take into account, during knitting proper, of the shrinkage rate obtained during the mechanical compression treatment.

The temperature of the heating cylinder is, in the case of viscose, of the order of 100° to 130° C.

After the mechanical compacting treatment, the weft knit may be subjected to a complementary finishing treatment, for example napping, with a view to increasing its bulk and to improving its touch.

A thermo-fusible polymer is then deposited on one of the faces of the weft knit. The choice of the polymer and the process for effecting deposit in the form of spots of this polymer on the face of said weft knit are not characteristic of the present invention. It may be question in particular of thermoplastic copolyamides and/or copolyesters and/or of chemical derivatives of one of them, or of both, alone or in combination with thermoplastic copolymers.

Although the proportion of thermo-fusible polymer is low with respect to the weight of the thermo-bonding interlining, in order to contribute to the biodegradable nature of the whole, it is desirable to use a polymer with low melting point.

Said thermo-bonding matter may be either in aqueous dispersion or in the form of powder and the process of application by spots is a function of the corresponding presentation.

In order to improve the dimensional stability of the thermo-bonding interlining further in certain applications, it may be advantageous to subject said thermoadhesive reinforcement to a complementary treatment of mechanical compacting of the same type as the one described previously, but in which the heating cylinder 1 is taken to a lower temperature, of the order of 40° to 80° C.

Apart from viscose, it is possible to employ other biodegradable cellulosic matters, for example cellulose acetate, and—in the case of the weft—cotton.

What is claimed is:

1. A process for making thermo-bonding interlining made from a weft knit, composed exclusively of yarns of biodegradable cellulosic matter, and a warp composed exclusively of continuous multifilament yarns, said process comprising:

(i) subjecting a weft knit to a first treatment of humidification and of mechanical compacting by passage between a heated cylinder and compression belt, wherein the temperature of the cylinder does not exceed 130° C.;

(ii) depositing spots of thermo-fusible polymer on the weft knit; and (iii) subjecting the weft knit with spots of the thermo-fusible polymer to a second treatment of humidification and mechanical compacting wherein the cylinder is heated to a temperature less than 80° C.

2. The process of claim 1 wherein the weft knit is viscose.

* * * * *